US005438929A

United States Patent [19]

Wong et al.

[11] Patent Number: 5,438,929

[45] Date of Patent: Aug. 8, 1995

[54] PRINTING STAMP

[75] Inventors: Kin-Sun Wong; Kam-Hung Wan, both of 3/F., West Wing, Chung Nam Building, 152-158 Johnston Road, Wanchai, Hong Kong

[73] Assignees: Kin-Sung Wong, Kowloon; Kam-Hung Wan, Wanchai, both of Hong Kong

[21] Appl. No.: 212,801

[22] Filed: Mar. 15, 1994

[30] Foreign Application Priority Data

Apr. 19, 1993 [GB] United Kingdom ..... 9307999

[51] Int. Cl.[6] ..... B41K 1/56

[52] U.S. Cl. ..... 101/405; 101/368

[58] Field of Search ..... 101/405, 406, 368

[56] References Cited

U.S. PATENT DOCUMENTS

| | | | |
|---|---|---|---|
| D. 227,003 | 5/1973 | Graham | D9/141 |
| D. 266,257 | 9/1982 | Ahrens | D18/15 |
| D. 273,120 | 3/1984 | Ito | D18/15 |
| D. 276,818 | 12/1981 | Carlsson et al. | D18/15 |
| D. 280,644 | 9/1985 | Ichikawa | D18/15 |
| D. 284,014 | 5/1986 | Iwasaki et al. | D18/15 |
| D. 346,396 | 4/1994 | Sculler | D18/18 |
| 3,302,566 | 2/1967 | Blanchet | 101/405 |
| 3,464,352 | 9/1969 | Schilling | 101/327 |
| 3,719,140 | 3/1973 | Hammel | 101/405 |
| 3,973,495 | 8/1976 | Rowe | 101/405 |
| 4,003,309 | 1/1977 | Munson | 101/327 |
| 4,123,973 | 11/1978 | Genevase | 101/406 |
| 4,594,943 | 6/1986 | Nettesheim et al. | 101/405 |
| 4,649,819 | 3/1987 | Voto, Jr. et al. | 101/405 |
| 4,735,143 | 4/1988 | Weir | 101/405 |
| 5,111,745 | 5/1992 | Wilson | 101/405 |

FOREIGN PATENT DOCUMENTS

| | | | |
|---|---|---|---|
| 779973 | 5/1922 | France . | |
| 651502 | 2/1929 | France . | |
| 2720367 | 11/1978 | Germany . | |
| 95045 | 6/1922 | Switzerland . | |
| 113368 | 1/1926 | Switzerland . | |
| 159585 | 2/1921 | United Kingdom . | |
| 395486 | 7/1933 | United Kingdom . | |
| 979434 | 1/1965 | United Kingdom . | |
| 1315769 | 5/1973 | United Kingdom . | |
| 2007597 | 5/1979 | United Kingdom . | |
| 2157626 | 10/1985 | United Kingdom . | |
| 2197821 | 6/1988 | United Kingdom . | |
| 2204832 | 11/1988 | United Kingdom | 101/405 |

OTHER PUBLICATIONS

English Language Abstract of DE 27 20 367.

M & R Marking Systems advertisement; Hand Stamp; May 1991; *Marking Industry Magazine.*

Tenney & Reese, Rubber Stamps Catalog; p. 29—top page, Ribbon Dating Stamps—American Dater.

Tenney & Reese, Rubber Stamps Catalog; p. 29—top page, Ribbon Dating Stamps—Railroad Dater.

*Primary Examiner*—Edgar S. Burr
*Assistant Examiner*—Anthony H. Nguyen
*Attorney, Agent, or Firm*—Sandler, Greenblum & Bernstein

[57] ABSTRACT

A printing stamp comprises a housing 9, a stamp mounting member 12 slidably mounted within the housing for movement between an inoperative position and a printing position, an operating member 11 for moving the stamp mounting member from its inoperative position to its printing position against the urging force of a spring 19 and a handle 10 connected to the operating member. The handle is releasably connected to the operating member such as by a slidable friction fit in order that the handle can be removed to allow the stamp to be more easily transported to points-of-need.

17 Claims, 1 Drawing Sheet

PRINTING STAMP

The invention relates to printing stamps.

Printing stamps are much used especially in offices and other business premises to mark letters, envelopes and other documents with addresses, dates and other information. The stamps are usually provided with individually prepared printing blocks held or supported by a mounting case inside a housing for printing an address, a company logo, or simply words such as "CONFIRMATION", "URGENT", "RECEIVED" and so on. The blocks are often "pre-inked" so that no ink charging is required during normal use.

Conventionally the stamps consist of an upstanding handle and a resiliently held mounting case. Each time the printer is used, the housing is placed on and above the document and the handle is pressed downwards so that the printing block is pressed against the surface of the document. However, these known stamps suffer from the drawback that they are bulky to carry around in a pocket, hand bag or brief case.

According to the invention there is provided a printing stamp comprising a housing, a stamp mounting member slidably mounted within the housing for movement between an inoperative position and a printing position, an operating member for moving the stamp mounting member from its inoperative position to its printing position against the urging force of resilient means and a handle releasably connected to the operating member so that the handle can be removed at will.

Preferably, the handle is slidably engaged as a friction fit with the operating member.

Advantageously, means are provided to adjust the position of the mounting member relative to the operating member. In this case, the adjusting means may comprise threaded engagement means between the operating member and the mounting member.

A printing stamp according to the invention will now be described by way of example with reference to the accompanying drawings in which.

Figure 1:
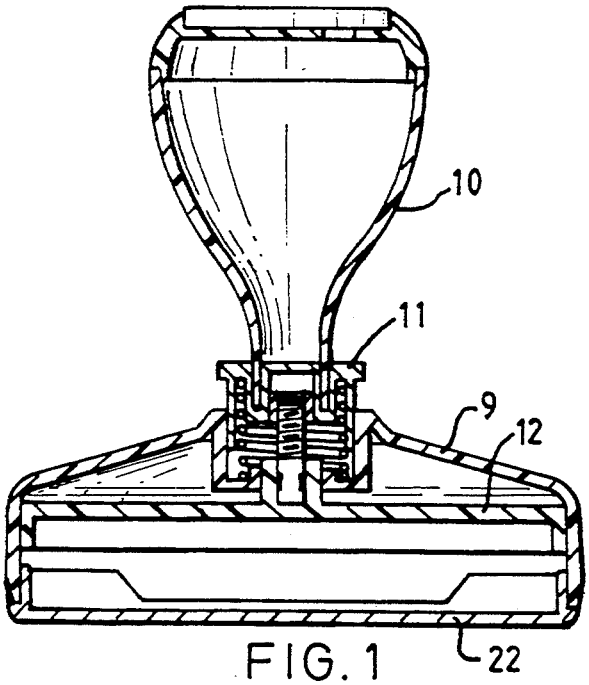
FIG. 1 is a sectional elevation of the printing stamp.
Figure 2:
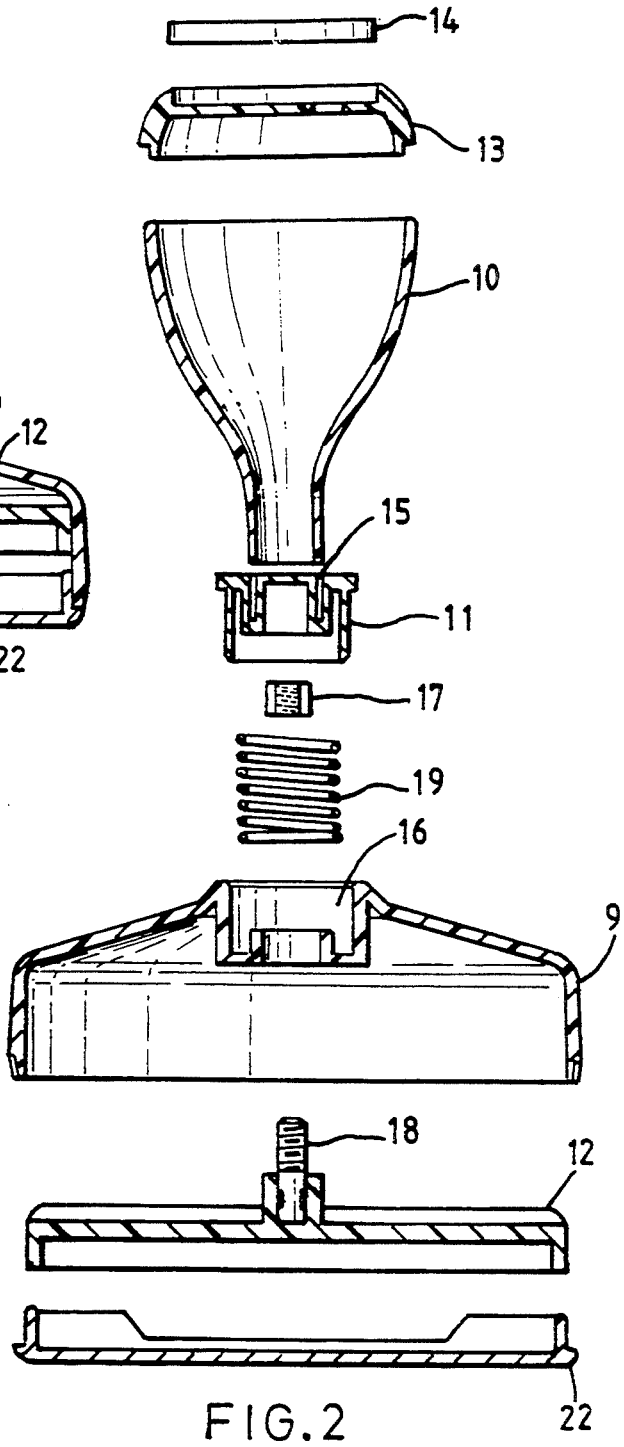
FIG. 2 is an exploded sectional elevation of the printing stamp.
Figure 3:
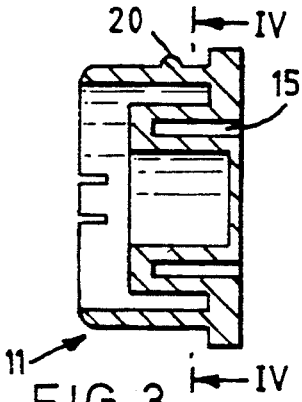
FIG. 3 is a sectional view of the operating member.
Figure 4:
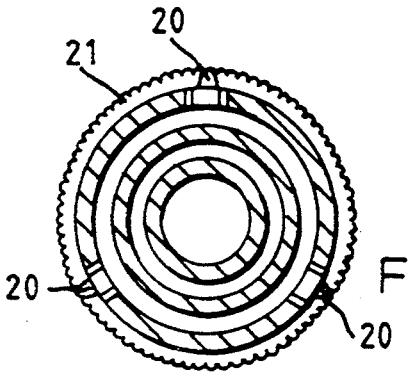
FIG. 4 is a section taken along line IV—IV of FIG. 3.

Referring to the drawings, the printing stamp shown therein comprises a housing 9, a handle 10, an operating member 11 and a stamp mounting member in the form of a mounting case 12 for receiving a printing block.

The handle 10 is hollow and has a generally conventional overall shape with a top 13 and a lens 14 which can be removed. A marker (not shown), identifying the stamp, can be inserted below and retained in the top of the handle by the lens 14. The bottom of the handle 10 is circular and is slidably engaged as a friction fit in an annular groove or recess 15 provided in the top of the operating member 11. The handle 10 is therefore releasably connected to the operating member 11 and can be separated therefrom by pulling the handle 10 away from the operating member 11 with enough force to overcome the friction fit.

The operating member 11 is slidably mounted in a recess 16 formed in the top of the housing 9 and is relatively small by comparison with the handle. The operating member 11 is connected to the mounting case 12 by a nut 17 entrapped in the operating member 11 and a bolt 18 rigidly connected to the mounting case 12. A compression spring 19 is interposed between the base of the recess 16 and the operating member 11 to urge the mounting case 12 to an inoperative position within the housing 9. In order to operate the printing stamp, the handle 10 or operating member 11 is simply pressed downwards in order to move the mounting case 12 against the urging force of the spring 19.

The position of the mounting case 12 with respect to the housing 9 can be adjusted in order to control the quality of print of the printing stamp by rotating the operating member 11 and hence the nut 17.

However, in order to avoid unintentional rotation, the operating member 11 has three radially outwardly projecting protrusions 20 which cooperate with a serrated inner surface 21 of the recess 16 to resist such rotation. This particular arrangement for resisting unintentional rotation in no way inhibits easy removal of the handle 10.

A dust cover 22 is provided for physically protecting the print lettering as well as dust ingress during non-use, transportation or storage.

The handle 10 is readily removed when required so considerably reducing the bulk of the printing stamp; the bulk reduction in one dimension can be up to 50% at least. It will be noted that the printing stamp can still be operated satisfactorily, that is pressed downwards, and adjusted when the handle 10 is removed. This means that printing stamps according to the present invention can be transported very easily to points-of-need, in a brief case, hand bag or pocket for example. Indeed, in a busy office a number of stamps may be stored in a relatively confined space and fitted with handles only when required for use. In fact, one handle can be used for a number of different printing stamps.

We claim:

1. A printing stamp comprising a housing, a stamp mounting member slidably mounted within the housing for movement between an inoperative position and an operative position at which printing can be performed, resilient means for urging said stamp mounting member to said inoperative position, an operating member for moving said stamp mounting member from the inoperative position to the operative position against the urging force of said resilient means, said operating member having an annular groove, and a handle releasably received in said annular groove of said operating member by a friction fit, so that said handle can be removed at will, said printing stamp being operable between the operative and inoperative positions both with said handle received in and removed from said annular groove of said operating member.

2. A stamp as claimed in claim 1, further comprising means for adjusting a position of said stamp mounting member relative to said operating member.

3. A stamp as claimed in claim 2, wherein said adjusting means comprises threaded engagement means between said operating member and said stamp mounting member.

4. The printing stamp according to claim 1, said resilient means comprising a spring received and retained between said operating member and said stamp mounting member.

5. The printing stamp according to claim 1, said handle removable from said operating member by application of an axial force, overcoming said frictional fit.

6. The printing stamp according to claim 2, further comprising means for preventing unintentional adjustment of said stamp mounting member relative to said operating member, said preventing means comprising a serrated surface provided on said housing and at least one protrusion projecting from said operating member for engagement with said serrated surface.

7. A printing stamp comprising a housing, a stamp mounting member slidably mounted within said housing for movement between an inoperative position and an operative position at which printing can be performed, resilient means for urging said stamp mounting member to the inoperative position, an operating member for moving said stamp mounting member from the inoperative position to the operative position against the urging force of said resilient means, said operating member including an annular groove, and a handle releasably received in said annular member of said operating member by a friction fit, so that said handle can be removed at will, an urging force of said resilient means, for moving said mounting member to the inoperative position, being maintained regardless of removal of said handle from said operating member.

8. The printing stamp according to claim 7, further comprising means for adjusting a position of said stamp mounting member relative to said operating member.

9. The printing stamp according to claim 8, wherein said adjusting means comprises threaded engagement means positioned between said operating member and said stamp mounting member.

10. The printing stamp according to claim 8, further comprising means for preventing unintentional adjustment of said stamp mounting member relative to said operating member, said preventing means comprising a serrated surface provided on a recess of said housing and at least one protrusion projecting from said operating member for engagement with said serrated surface.

11. The printing stamp according to claim 7, said handle being fixedly positioned with respect to said operating member.

12. A printing stamp comprising:

a housing having a recess;

a stamp mounting member received within said housing;

an operating member secured to said stamp mounting member, said operating member having a first recess facing said recess of said housing;

a handle slidably engaged by a friction fit with said operating member;

resilient means, provided between said housing and said operating member, for biasing said stamp mounting member to a retracted inoperative position within said housing;

said operating member comprising means for moving said stamp mounting member from the inoperative position to an operative printing position against the resilient biasing force of said resilient means, said operating member being received within said recess of said housing, said resilient means extending into said recess of said housing and into said first recess of said operating member, said operating member defining an additional recess extending in a direction opposite to the direction of said first recess, said handle being received within said additional recess of said operating member.

13. The printing stamp according to claim 12, said stamp mounting member including a threaded member, and a nut, received within a further recess of said operating member, being engaged with said threaded member.

14. The printing stamp according to claim 12, said additional recess of said operating member comprises an annular groove.

15. The printing stamp according to claim 12, further comprising means for adjusting the position of the stamp mounting member relative to said operating member.

16. The printing stamp according to claim 15, said adjusting means comprising threaded engagement means between said operating member and said stamp mounting member.

17. The printing stamp according to claim 16, further comprising means for preventing unintentional adjustment of said stamp mounting member relative to said operating member, said preventing means comprising a serrated surface provided on said recess of said housing and at least one protrusion projecting from said operating member for engagement with said serrated surface.

* * * * *

UNITED STATES PATENT AND TRADEMARK OFFICE

CERTIFICATE OF CORRECTION

PATENT NO. : 5,438,929
DATED : August 8, 1995
INVENTOR(S) : K. WONG et al.

It is certified that error appears in the above-indentified patent and that said Letters Patent is hereby corrected as shown below:

On the cover, in section [75], "Inventors:", lines 2 through 4, delete "3/F., West Wing, Chung Nam Building, 152-158 Johnston Road, Wanchai,".

On the cover, in section [75], "Inventors:", line 1, after "Kin-Sun Wong" insert ---, Kowloon---.

On the cover, in section [75], "Inventors:", line 1, after "Kam-Hung Wan" insert ---New Territories,---.

On the cover, in section [56], "References Cited", "U.S. PATENT DOCUMENTS", line 4, change "12/1981" to --- 12/1984---.

Signed and Sealed this

Third Day of December, 1996

Bruce Lehman

*Attest:*

BRUCE LEHMAN

*Attesting Officer*

*Commissioner of Patents and Trademarks*